US007021730B2

(12) United States Patent
Remmers

(10) Patent No.: US 7,021,730 B2
(45) Date of Patent: Apr. 4, 2006

(54) DRAWER BRACKET

(75) Inventor: Lee E. Remmers, Ocala, FL (US)

(73) Assignee: Clairson, Inc., Newark, DE (US)

( * ) Notice: Subject to any disclaimer, the term of this patent is extended or adjusted under 35 U.S.C. 154(b) by 0 days.

(21) Appl. No.: 10/424,681

(22) Filed: Apr. 28, 2003

(65) Prior Publication Data

US 2004/0211869 A1 Oct. 28, 2004

(51) Int. Cl.
*A47B 96/00* (2006.01)
*A47G 29/02* (2006.01)

(52) U.S. Cl. ..... 312/404; 312/408; 248/235; 108/108

(58) Field of Classification Search ..... 248/235, 248/247, 248, 250, 300, 316.8; 108/152, 108/108, 26; 29/897; 211/90.02, 90.03, 211/94.02; 312/404, 408
See application file for complete search history.

(56) References Cited

U.S. PATENT DOCUMENTS 2,750,052 A * 6/1956 Brown et al. ..... 108/143
3,099,501 A * 7/1963 Hillson et al. ..... 384/19
3,185,426 A * 5/1965 Bjerke ..... 248/250
3,355,134 A * 11/1967 Chesley ..... 248/250
3,677,615 A * 7/1972 Hudson ..... 384/20
3,701,325 A * 10/1972 Fenwick ..... 108/1
4,121,876 A * 10/1978 Ratti ..... 384/19
4,589,349 A * 5/1986 Gebhardt et al. ..... 108/102
4,597,616 A 7/1986 Trubiano
4,720,069 A * 1/1988 Bessinger ..... 248/250
4,732,284 A 3/1988 Remmers
4,735,470 A * 4/1988 Falk ..... 312/246
4,776,472 A * 10/1988 Rosen ..... 211/187
4,783,035 A 11/1988 Remmers
4,792,195 A * 12/1988 Adriaansen et al. ..... 312/245
D323,088 S * 1/1992 Fler ..... D6/510
5,086,936 A 2/1992 Remmers
5,205,630 A 4/1993 Welch et al.
5,346,077 A * 9/1994 Randall ..... 211/90.03
5,486,046 A * 1/1996 Jernstrom et al. ..... 312/408
5,524,981 A * 6/1996 Herrmann et al. ..... 312/408
5,531,464 A 7/1996 Maurer et al.
5,580,018 A 12/1996 Remmers
5,605,238 A 2/1997 Jacobs
5,641,217 A * 6/1997 Caruso et al. ..... 312/404
5,720,230 A * 2/1998 Mansfield ..... 108/108
5,752,610 A 5/1998 Remmers
5,810,179 A 9/1998 Kleiman
D408,175 S 4/1999 Daniels et al.
5,909,936 A 6/1999 Daniels et al.
6,070,957 A * 6/2000 Zachrai ..... 312/334.4
6,467,860 B1 * 10/2002 Remmers ..... 312/334.7
6,505,800 B1 * 1/2003 Abdullah ..... 248/250

FOREIGN PATENT DOCUMENTS

AT 260460 * 3/1968
GB 2236243 A * 4/1991

* cited by examiner

*Primary Examiner*—Anita M. King
(74) *Attorney, Agent, or Firm*—Harness, Dickey & Pierce, P.L.C.

(57) ABSTRACT

A drawer bracket is configured for connection to conventional wall mounted standards and provides for supporting a drawer in a generally horizontal orientation. A drawer receiving channel allows for sliding movement of the drawer supported by the drawer bracket. A shelf member may be provided for connection to the drawer bracket to form a shelf above a supported drawer.

19 Claims, 4 Drawing Sheets

DRAWER BRACKET

FIELD OF THE INVENTION

The present invention relates generally to storage systems, and more particularly to a drawer bracket for use in connection with a wall mounted support for supporting a drawer therefrom and allowing sliding operation thereof.

BACKGROUND OF THE INVENTION

Efficient and organized use of building space is very desirable, particularly with respect to storage or utility space in businesses, residential homes and apartments. From appliances having space saving designs (e.g., washer and drawer stacked on top of one another) to storage organizer units (e.g., wall mounted wire shelving kits), manufacturers continue to develop new designs to maximize use of space, while maintaining ease in access and user convenience.

With respect to the design of storage units, such as closet storage units, particularly for residential use, many different options are available including, for example, different sizes and shapes of shelves, different attachment and mounting members (e.g., brackets and standards) and different storage members (e.g., wire baskets, shoe stands and tie/belt racks). Ease in accessing stored items such as, for example, clothing is typically important. Further, flexibility in design and maximizing use of available space is likewise typically important.

It is known to use wall mounted standards in connection with brackets for constructing storage systems wherein shelves are supported on top of the brackets. These systems allow for connection of the brackets to different portions (e.g., slots) of the standards to allow for flexibility in the vertical positioning of shelves supported by the brackets. Typically, ventilated shelving or other types of shelving (e.g., wooden shelves) are supported above and on the brackets to maintain the shelves in a generally horizontal orientation for storage of items thereon.

Using known standards and brackets, flexibility in storage design and use of storage space is typically limited to shelving attached and supported by the brackets. In particular, items may be stored on the shelves supported by the brackets, hung from the wires (e.g., longitudinally extending support wires) of the shelves or hung from a hang rod attached to the shelves. However, use of the storage area below the shelves supported by the brackets is limited, and if used, often difficult to access and/or difficult to move items stored, and in particular hung thereunder. Thus, although known standards and brackets allow for changing the vertical positioning of shelves, use of the storage space is often not maximized, and it may be difficult to access certain items stored under or next to the shelves. Further, additional units, for example, stand alone basket units often have to be used, for example, on the floor under the lowest shelf, to provide more efficient use of the space. This adds cost to the storage units and these basket units are often difficult to install because of the amount of available space, as well as the size of the particular basket unit.

SUMMARY OF THE INVENTION

A drawer bracket according to the present invention for use with standards provides for supporting drawers and allowing sliding operation thereof. Further, the drawer bracket provides for supporting shelving thereon (e.g., supporting ventilated shelving thereon) with the drawers maintained thereunder. The drawer bracket is preferably configured to receive and support a drawer between two parallel brackets mounted to conventional standards, and allows for sliding of the drawer without the need for wheels or other sliding members. The drawer bracket is preferably configured for removable connection to the conventional standards.

In one embodiment of the present invention, a bracket for use in connection with mounting standards includes a drawer receiving channel for receiving therein the lip of a drawer and configured to allow for sliding of the drawer lip therethrough. The drawer receiving channel may include a generally horizontally extending support surface and may have a generally U-shaped cross-section. Further, the bracket may have a generally U-shaped top channel facing oppositely to the drawer receiving channel and together forming a generally S-shaped cross-section. A shelf member configured for removable connection to a pair of brackets also may be provided.

In another embodiment of the present invention, a bracket for mounting on a wall standard to slidably support a drawer includes at least one engagement member for engaging the wall standard to mount the bracket on the standard, and a support surface formed in the bracket and extending generally horizontally when the bracket is mounted on the wall standard to slidably support a portion of the drawer. The support surface may include opposing top and bottom walls and/or a wall of a laterally facing groove in the bracket. The bracket may further include a laterally facing groove having opposed upper and lower surfaces, with the lower surface forming the support surface.

In still another embodiment of the present invention, a drawer system for mounting a drawer in wall standards on a wall includes left and right brackets for mounting on wall standards in laterally opposed relation, with each bracket having at least one engagement member a for engaging the wall standard to mount the bracket on the wall standard. A support surface formed in the bracket and extending generally horizontally when the bracket is mounted on the wall standard to slidably support a portion of a drawer is also provided. Further, a drawer adapted to be slidably mounted between the left and right brackets is provided, with the drawer having left and right flanges on opposite sides for slidably engaging the support surfaces of the left and right brackets. A drawer support channel may be included having the support surface, with the drawer support channel configured having a generally U-shaped cross-section. A shelf member configured for removable connection to top portions of the left and right brackets also may be provided.

In yet another embodiment of the present invention, a method of mounting a drawer on wall standards includes forming a support surface in a bracket having a fastener for engaging a wall standard, with the support surface configured such that a pair of brackets mounted on wall standards in laterally opposed relation support a drawer therebetween in a generally horizontal orientation. The support surface may be provided as part of a channel and the method further may include forming a second channel above the support channel, with each channel having a generally U-shaped cross-section and together forming a generally S-shaped cross-section.

Further areas of applicability of the present invention will become apparent from the detailed description provided hereinafter. It should be understood that the detailed description and specific examples, while indicating certain preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Corresponding reference numerals represent corresponding parts throughout the several views of the drawings.

DETAILED DESCRIPTION OF THE PREFERRED EMBODIMENTS

The following description of the preferred embodiments is merely exemplary in nature and is in no way intended to limit the invention, its application, or uses. Although, embodiments of a drawer bracket according to the present invention are described having a particular shape and size for use in supporting drawers of particular dimensions, they are not so limited, and different shapes and sizes of brackets may be used for supporting different types and sizes of shelves.

Figure 1:
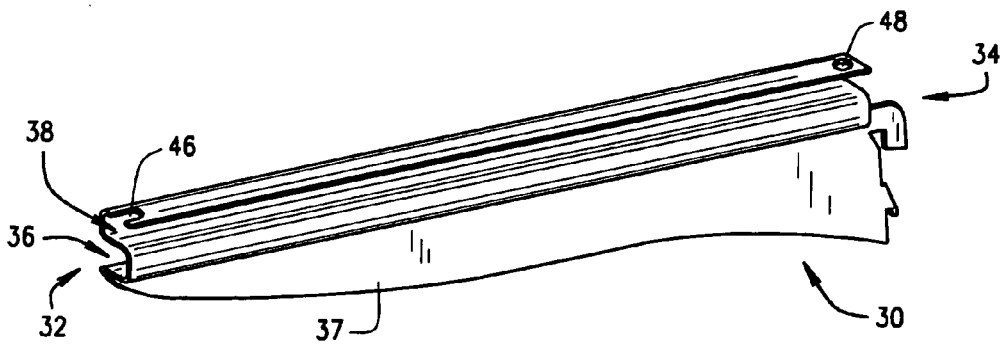
FIG. 1 is a side perspective view of one embodiment of a right drawer bracket constructed according to the principles of the present invention, the left drawer bracket being a mirror image thereof.
Figure 2:
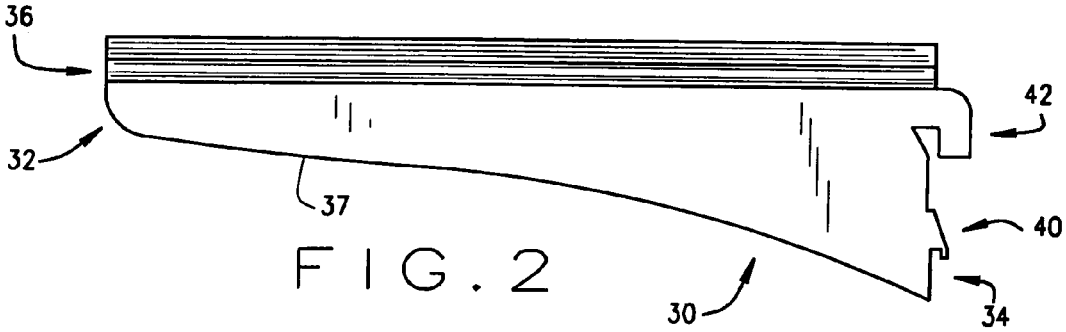
FIG. 2 is a side elevation view of the right drawer bracket of FIG. 1.
Figure 4A:
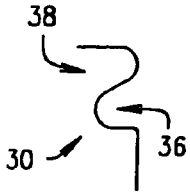
FIGS. 4A and 4B are front elevation views of left and right drawer brackets according to the present invention.
Figure 4B:
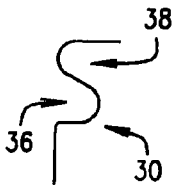

A drawer bracket, and more specifically a right drawer bracket constructed according to the principles of the present invention is shown generally in FIGS. 1 and 2 and identified by reference numeral 30. A left drawer bracket constructed according to the principles of the present invention has the same configuration, but is a mirror image of the right drawer bracket. As shown therein, the drawer bracket 30 is preferably constructed as a one piece member having a first end 32 and a second end 34. The first end 32 is configured for receiving therein a drawer to be supported by the drawer bracket 30 with the second end 34 configured for attachment to a support member, and more preferably a conventional wall mounted standard. Specifically, a drawer receiving channel 36 extends from the first end 32 to the second end 34. The drawer receiving channel 36 is located above a bracket support member or web 37 and below a top channel 38. The drawer receiving channel 36 has a generally U-shaped cross-section oriented sideways so that the drawer receiving channel 36 has an upper and lower wall, and a back wall smoothly connected to the upper and lower walls. The top channel 38 preferably has a similar configuration and faces oppositely, with the drawer receiving channel 36 and top channel 38 forming a generally S-shaped cross-section as shown in FIGS. 4A and 4B. This configuration helps to stiffen the drawer bracket 30 against flexing and bending. It should be noted that the configuration of the drawer receiving channel 36 may be modified as needed or desired. For example, the drawer receiving channel 36 may be constructed having the upper and lower walls and no back wall, thereby forming a longitudinally extending slit between the first end 32 and the second end 34.

In a more preferred construction, the bracket support member or web 37 is configured generally downward sloped from the first end 32 to the second end 34. Specifically, the bracket support member or web 37 widens towards the second end 34 and narrows or tapers towards the first end 32. The second end 34 includes a first engagement member 40 and a second engagement member 42 configured for attaching the drawer bracket 30 to a support member, such as for example, to a conventional wall mounted standard as is known. In particular, the first engagement member 40 and second engagement member 42 are configured to fit in the longitudinally extending slots in a conventional standard to maintain the drawer bracket 30 in a generally horizontal orientation. The engagement members 40 and 42 are configured for receiving an engaging portion of the wall mounted standard surrounding the slots. It should be noted that the configuration of each of the first engagement member 40 and second engagement member 42 may be modified based upon the particular mounting requirements, for example, the size and shape of the particular standard or other support member to which the drawer bracket 30 is to be mounted. Any other method of mounting the drawer brackets 30 can be used without departure from this invention.

Figure 7:
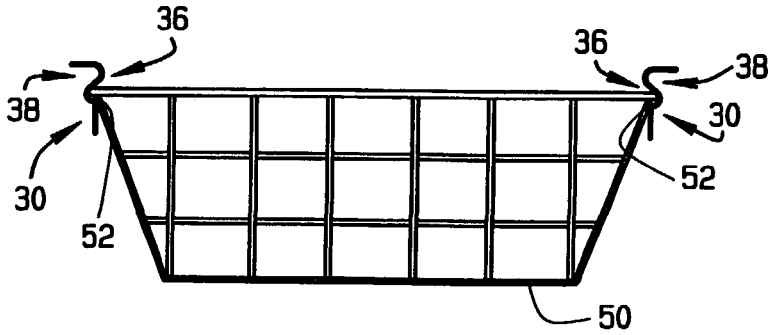
FIG. 7 is a front elevation view showing a wire basket supported by drawer brackets according to the present invention.

Thus, and as shown in detail in FIGS. 4A and 4B, the drawer receiving channel 36 extends substantially the entire length of the drawer bracket 30 from the first end 32 to the second end 34 below and adjacent to the top channel 38 to form the generally S-shaped cross-section. The drawer receiving groove 36 is configured to slidably receive the top lip or flange of a drawer therein and to allow for sliding of the drawer between the first end 32 and second end 34. As shown in FIG. 7, and for example, two drawer brackets 30 having oppositely facing drawer receiving channels 36 (e.g., left and right drawer brackets 30) are configured for connection to conventional wall mounted standards (not shown) using the first engagement member 40 and second engagement member 42, and for supporting therebetween a drawer, such as a wire basket 50 in a generally horizontal orientation. The drawer brackets 30 preferably allow for sliding movement of top side edges or lips 52 (e.g., flanges) of the wire basket 50 through the drawer receiving channel 36.

Figure 4C:
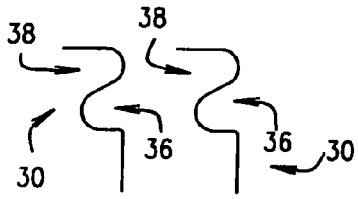
FIG. 4C is a front elevation view of a pair of left drawer brackets according to the present invention.

It should be noted that the configuration of the drawer receiving channel 36 and top channel 38 may be modified to receive different drawers. For example, the shape and length of the drawer receiving channel 36 and top channel 38 may be modified as needed or desired. Further, a pair of drawer brackets 30 having drawer receiving channels 36 facing the same direction as shown in FIG. 4C may be used to support a drawer therebetween, with the flanges of a drawer modified (e.g., a side flange higher on one side than the other side for receiving the top channel 38 on the one side and the drawer receiving channel 36 on the other side, respectively).

Figure 3:
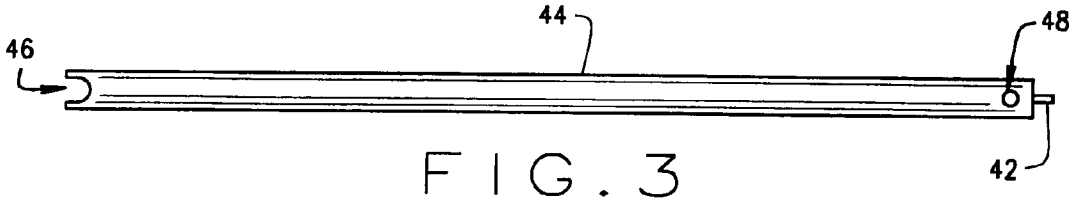
FIG. 3 is a top plan view of the right drawer bracket of FIG. 1.

Referring now to FIG. 3, the upper wall of the top channel 38 preferably forms the top surface 44 thereof, and has means for restraining the generally horizontal movement of a shelf member. In a preferred embodiment, this means for restraining includes an indent 46 at the first end 32 of the drawer bracket 30 and an aperture 48 at the second end of the drawer bracket 30. The indent 46 and aperture 48 are configured to receive engagement portions of a shelf member as described in more detail below.

Figure 5:
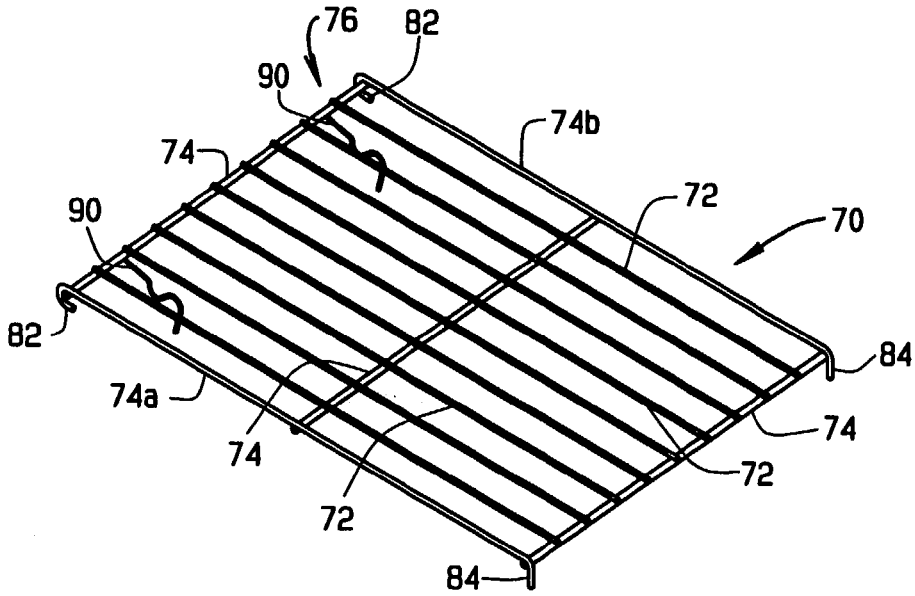
FIG. 5 is a top perspective view of a shelf member for use in connection with the various embodiments of a drawer bracket according to the present invention.
Figure 6:
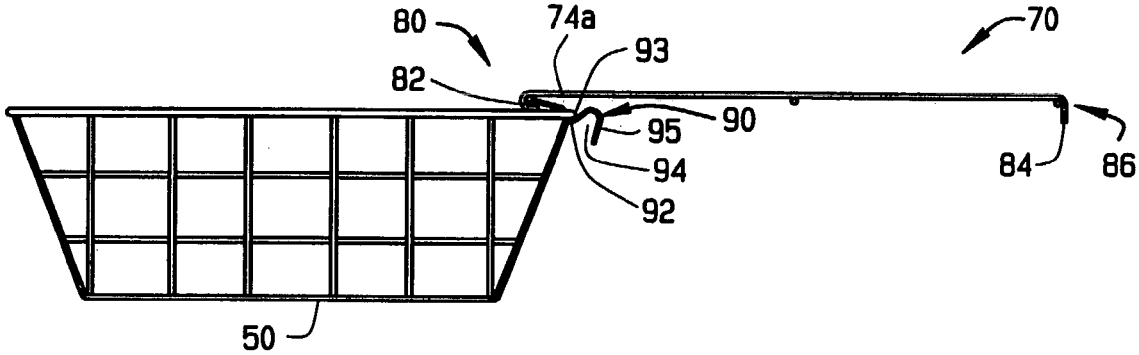
FIG. 6 is a side elevation view of the shelf member of FIG. 5 shown mounted on a drawer bracket constructed according to the present invention.

Referring now to FIGS. 5 and 6, a shelf member 70 also may be provided in connection with the drawer brackets 30. In particular, the shelf member 70 includes a plurality of transversely extending wire members 72 (i.e., wire stringers) supported by a plurality of longitudinally extending support members 74 to form a shelf deck 76. Further, longitudinally extending support members 74*a* and 74*b* form the sides of the shelf portion 70. In particular, and as shown in FIG. 6, each of the longitudinally extending support members 74*a* and 74*b* include at a front end 80 a first engagement portion 82 for engaging the indent 46 on the top surface 44 of the top channel 38 (shown in FIG. 3), and a second engagement portion 84 at a back end 86 for engaging the aperture 48 on the top surface 44 of the top channel 38 (shown in FIG. 3). Specifically, the first engagement portion 82 is configured generally downwardly and concave for engagement around the indent 46 and extending a distance into the top channel 38. The second engagement portion 84 is configured as a generally downward projection for insertion within the aperture 48. The first engagement portions 82 and the second engagement portions 84 are thereby configured to provide secure engagement of the shelf member 70 to a pair of drawer brackets 30 (i.e., left and right drawer brackets 30). This way the shelf member 70 can help stabilize the drawer brackets 30, maintaining the separation to keep the drawer engaged between them. However, the shelf member 70 is not essential to all embodiments and the drawer brackets 30 can function to support a drawer without the shelf member 70.

Further, the shelf member 70 can include resilient drawer stop members 90 for resisting a drawer, such as a wire basket 50 supported between two drawer brackets 30, from being pulled completely from the front end 32 of the drawer brackets 30 or for locking the wire basket 50 in an open position. Specifically, the drawer stop members 90 each have a generally "S" shape, with a first curved portion 92, a second curved portion 94 and a vertical stop portion 95. The stop members 90 are configured to engage the back top edge 93 of a wire basket 50.

Specifically, as the wire basket 50 is moved forward (i.e., in the direction of the front end 32 of the drawer bracket 30), the resilient drawer stop members 90 allow sliding movement of the top side edges or lips 52 of the wire basket 50 through the drawer receiving channels 36 until the vertical stop portion 95 engages the back top edge 93 of the wire basket 50 (i.e., stopped position). The drawer stop member 90 is also configured for depression to allow the wire basket 50 to move past a stopped position to an open locked position as shown in FIG. 6, wherein the back top edge 93 of the wire basket 50 engages the first curved portion 92 (i.e., drawer stop member 90 bends downward to receive and engage back top edge 93 and bends back up as a result of its resiliency). If removal of the wire basket 50 is desired or needed, the drawer stop members 90 may be moved upward to allow for the back top edge 93 to move thereunder and the wire basket 50 removed (e.g., for transporting the wire basket 50 with its contents to another room).

It should be noted that shelf member 70 may be connected or removed from the drawer brackets 30 as desired or needed. For example, if storage of items taller than the wire basket 50 is desired or needed, the drawer brackets 30 may be used without the shelf member 70.

Figure 8:
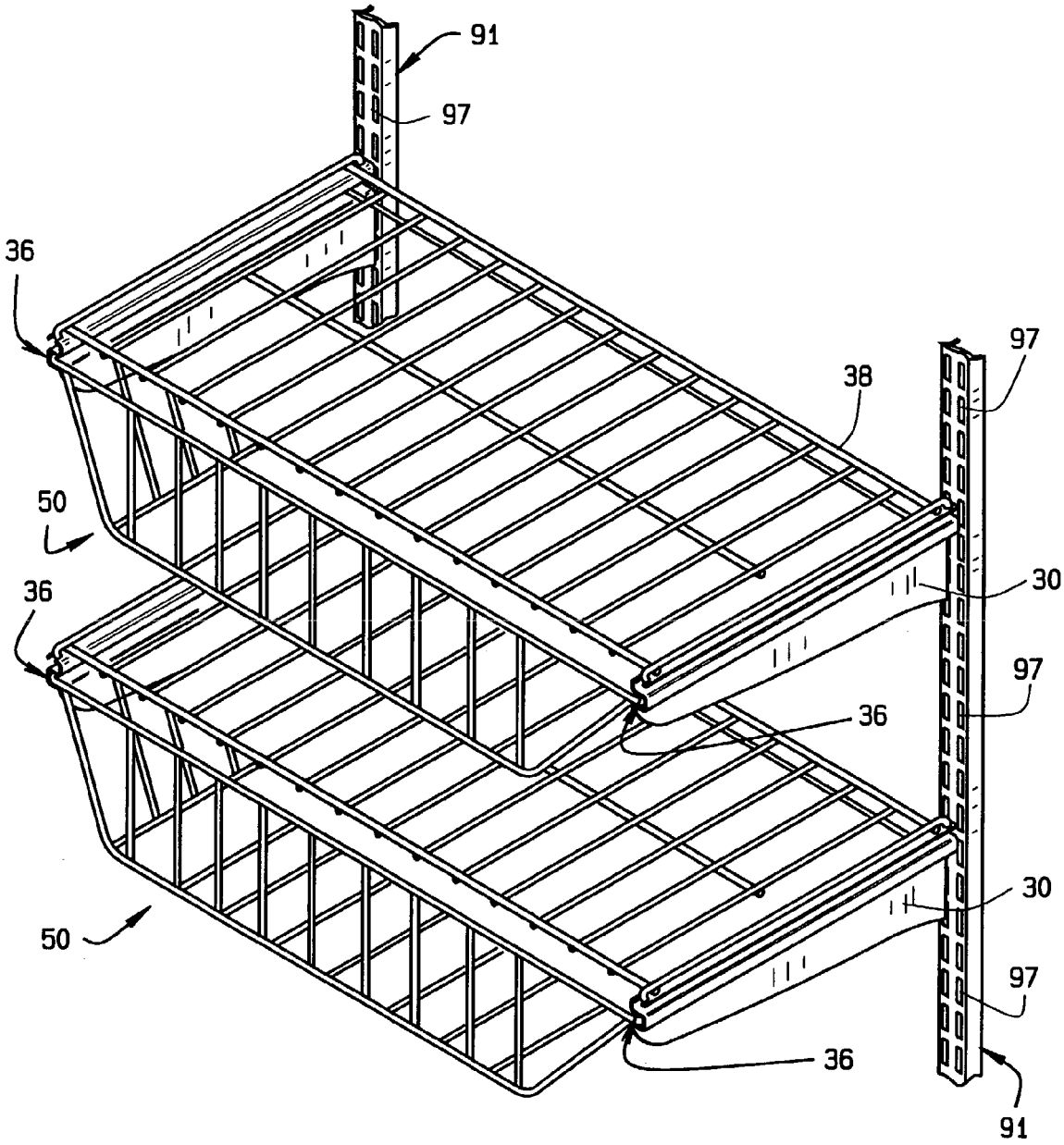
FIG. 8 is a perspective view of two pairs of drawer brackets constructed according to the present invention, shown connected to standards and supporting drawers between them.
Figure 9:
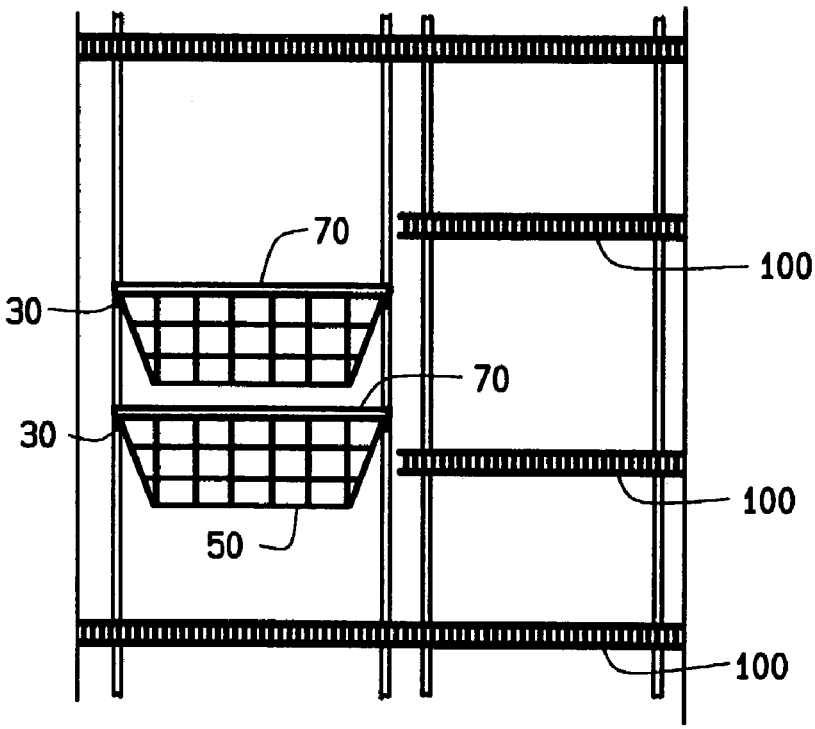
FIG. 9 is a front elevation view of drawer brackets constructed according to the present invention, shown connected to standards in combination with a storage unit.
Figure 10:
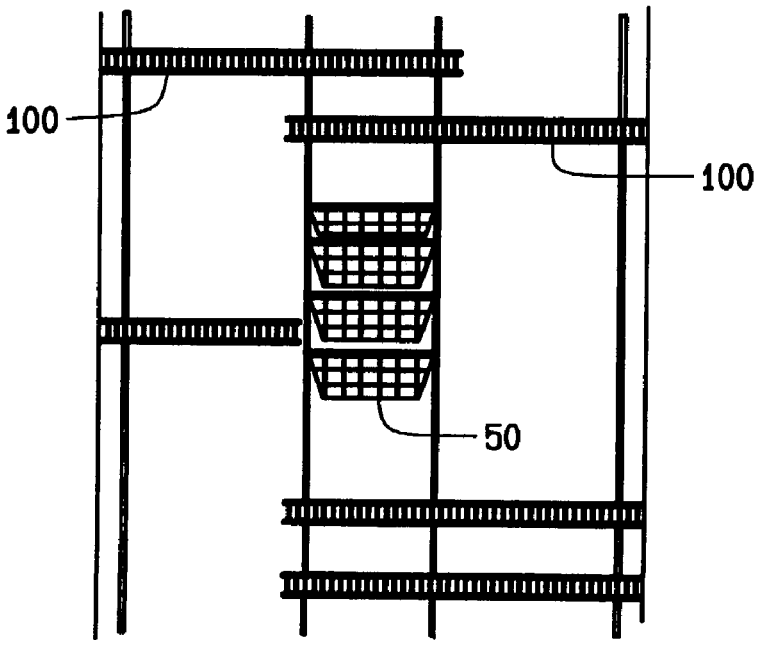
FIG. 10 is a front elevation view of drawer brackets constructed according to the present invention, shown connected to standards in combination with a closet storage unit.

Thus, in operation, and for example as shown in FIG. 8, an embodiment of a pair of drawer brackets 30 having opposing faced drawer receiving channels 36 are connected to conventional wall mounted standards 91. A wire basket 50 or other drawer member is supported between the drawer brackets 30 and allowed to slide within the drawer receiving channels 36. Further, the shelf member 70 engages the top surfaces 44 of the drawer brackets 30 to form a shelf deck 76 for supporting items thereon. It should be noted that the drawer brackets 30 may be attached at different vertical positions using different slots 97 of the standards 91. Further, the standards 91 may be mounted apart at different distances to accommodate drawers, including, for example, wire baskets 50 having different widths. Further, the length of the drawer brackets 30 may be modified to accommodate different length drawers. Thus, and as shown in FIGS. 9 and 10, drawer brackets 30 of the present invention may be used to support drawers, and in particular wire baskets 50 in combination with ventilated shelving 100, such as wire shelving, to form a storage unit (e.g., closet storage unit).

The drawer bracket 30 is not limited to the embodiments and configurations as described herein. Drawer brackets constructed according to principles of the present invention may be modified to allow for use in connection with different drawer sizes, types and configurations, and for use in connection with different shelving units and storage systems. For example, the size of the drawer receiving channel 36 may be modified to accommodate different sizes of drawer sides. Further, and for example, a hat-shaped support member with longitudinally extending flanges may be provided in connection with and on top of a drawer bracket to support a drawer between pairs of brackets.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A bracket for use in connection with mounting standards, the bracket comprising:

a drawer receiving channel for receiving therein a lip of a drawer and configured to allow for sliding of the drawer lip therethrough, the drawer receiving channel configured having a generally U-shaped cross-section;

a shelf support adjacent the drawer receiving channel for removably supporting a shelf member, the shelf support including means for restraining generally horizontal movement of the shelf member, and a generally U-shaped top channel facing oppositely to the drawer receiving channel and together forming a generally S-shaped cross-section; and at least one engagement member for engaging a standard to mount the bracket to the standard.

2. The bracket according to claim 1 wherein the drawer receiving channel comprises a generally horizontally extending support surface.

3. The bracket according to claim 1 wherein the drawer receiving channel is configured to receive therein and allow a generally horizontally extending lip of a drawer to be slidably moved along substantially an entire length of the drawer receiving channel.

4. The bracket according to claim 1 wherein the means for restraining comprises an aperture defined by an upper surface of the bracket.

5. The bracket according to claim 4 wherein the upper surface further defines an indent.

6. A bracket for mounting on a wall standard to slidably support a drawer, the bracket comprising:

at least one engagement member for engaging the wall standard to mount the bracket to the standard;

a support surface formed in the bracket and extending generally horizontally when the bracket is mounted on the wall standard to slidably support a portion of the drawer;

a shelf support adjacent the support surface for removably supporting a shelf member, the shelf support including means for restraining generally horizontal movement of the shelf member; and oppositely facing grooves formed in the bracket adjacent a top, a wall of one of the grooves forming a top surface of the bracket and a wall of the other groove forming the support surface.

7. The bracket according to claim 6 wherein the support surface comprises opposing top and bottom walls of said other groove forming the support surface.

8. The bracket according to claim 6 wherein the support surface comprises a wall of a laterally facing groove in the bracket.

9. The bracket according to claim 6 wherein said other groove forming the support surface comprises a laterally facing groove having opposed upper and lower surfaces, the lower surface forming the support surface.

10. The bracket according to claim 6 further comprising a top surface and wherein the support surface is spaced vertically below the top surface.

11. The bracket according to claim 6 wherein the bracket is configured to allow a generally horizontally extending lip of the drawer to be slidably moved along substantially an entire length of the support surface.

12. The bracket according to claim 6 wherein the bracket, the engagement member, and the support surface are monolithically formed as a single component.

13. The bracket according to claim 6 wherein the engagement member is configured to fit into a slot defined in the standard to mount the bracket to the standard.

14. An apparatus comprising:

at least one bracket including an upper surface defining an indent and an aperture therethrough, at least one engagement member for engaging a standard to mount the bracket to the standard, and a support surface formed in the bracket and extending generally horizontally when the bracket is mounted on the wall standard to slidably support a portion of a drawer; and a shelf member including a first engagement portion and a second engagement portion;

the first engagement portion of the shelf member is configured generally downwardly and concave for engagement around the indent; and the second engagement portion comprises a generally downward projection for insertion within the aperture.

15. A drawer system for mounting a drawer in wall standards on a wall, the drawer system comprising:

left and right brackets for mounting on wail standards in laterally opposed relation, each bracket comprising at least one engagement member for engaging the wall standard to mount the bracket on the wall standard, and a support surface formed in the bracket and extending generally horizontally when the bracket is mounted on the wall standard;

a drawer adapted to be slidably mounted between the left and right brackets, the drawer having left and right flanges on opposite sides for slidably engaging the support surfaces of the left and right brackets; and a shelf member connectable to the bracket, the shelf member including at least one resilient drawer stop configured to resist completely sliding the drawer from the support surface;

each said left and right bracket including a shelf support for removably supporting the shelf member, at least one of said left and right brackets including means for restraining generally horizontal movement of the shelf member.

16. The drawer system according to claim 15 further comprising a drawer support channel having the support surface.

17. The drawer system according to claim 16 wherein the drawer support channel is configured having a generally U-shaped cross-section.

18. The drawer system according to claim 15 wherein the shelf member is configured for removable connection to top surfaces of the left and right brackets.

19. A drawer system for mounting a drawer in wall standards on a wall, the drawer system comprising:

left and right brackets for mounting on wall standards in laterally opposed relation, each bracket comprising at least one engagement member for engaging the wall standard to mount the bracket on the wall standard, and a support surface formed in the bracket and extending generally horizontally when the bracket is mounted on the wall standard to slidably support a portion of a drawer;

a drawer adapted to be slidably mounted between the left and right brackets, the drawer having left and right flanges on opposite sides for slidably engaging the support surfaces of the left and right brackets; and a shelf member connectable to the left and right brackets, the shelf member including at least one resilient drawer stop configured to resist completely sliding a drawer from the support surfaces of the left and right brackets.

* * * * *

UNITED STATES PATENT AND TRADEMARK OFFICE

CERTIFICATE OF CORRECTION

PATENT NO. : 7,021,730 B2
APPLICATION NO. : 10/424681
DATED : April 4, 2006
INVENTOR(S) : Lee E. Remmers It is certified that error appears in the above-identified patent and that said Letters Patent is hereby corrected as shown below:

Column 2,
Line 38, delete “a” after “engagement member.”.

Column 8,
Line 8, replace “wail” with -- wall. --.

Signed and Sealed this

Twenty-seventh Day of June, 2006

JON W. DUDAS
*Director of the United States Patent and Trademark Office*